US011466865B2

(12) United States Patent
Lee et al.

(10) Patent No.: US 11,466,865 B2
(45) Date of Patent: Oct. 11, 2022

(54) COOKING APPLIANCE

(71) Applicant: SAMSUNG ELECTRONICS CO., LTD., Suwon-si (KR)

(72) Inventors: Chul Woo Lee, Suwon-si (KR); Won Woo Ko, Suwon-si (KR); Sun Ki Kim, Suwon-si (KR); Eon Joong Kim, Suwon-si (KR); Ju Hee Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 256 days.

(21) Appl. No.: 16/652,195

(22) PCT Filed: Sep. 4, 2018

(86) PCT No.: PCT/KR2018/010258

§ 371 (c)(1),
(2) Date: Mar. 30, 2020

(87) PCT Pub. No.: WO2019/066280

PCT Pub. Date: Apr. 4, 2019

(65) Prior Publication Data

US 2020/0248909 A1 Aug. 6, 2020

(30) Foreign Application Priority Data

Sep. 29, 2017 (KR) ..... 10-2017-0127899

(51) Int. Cl.
*F24C 5/20* (2021.01)
*F24C 15/20* (2006.01)
(Continued)

(52) U.S. Cl.
CPC ..... *F24C 15/20* (2013.01); *F24C 15/02* (2013.01); *F24F 13/08* (2013.01); *H05B 6/64* (2013.01)

(58) Field of Classification Search
CPC ..... F24C 15/006; F24C 15/20; F24C 15/02; A47J 36/38
(Continued)

(56) References Cited

U.S. PATENT DOCUMENTS 3,186,401 A * 6/1965 Mayer ..... F24C 15/30 126/200
4,180,049 A * 12/1979 Carr ..... H05B 6/642 219/400
(Continued)

FOREIGN PATENT DOCUMENTS

JP 2004-61098 A 2/2004
KR 20-1997-0063310 U 12/1997
(Continued)

OTHER PUBLICATIONS

Written Opinion of the International Searching Authority dated Jan. 9, 2019 in corresponding International Application No. PCT/KR2018/010258.
(Continued)

*Primary Examiner* — Ko-Wei Lin
(74) *Attorney, Agent, or Firm* — Staas & Halsey LLP

(57) ABSTRACT

The present disclosure relates to a cooking appliance disposed above a household appliance to simultaneously perform a hood function and an oven function. The cooking appliance includes a housing, a base plate configured to be coupled to the housing, a cooking chamber disposed inside the housing, a door coupled to the housing to open and close the cooking chamber, and a deflector spaced apart from a lower end of the door and coupled to a front edge of the base plate to cover the lower end of the door from hot air generated and transferred from a household appliance installed below the base plate.

12 Claims, 10 Drawing Sheets

(51) Int. Cl.
*F24C 15/02* (2006.01)
*F24F 13/08* (2006.01)
*H05B 6/64* (2006.01)

(58) Field of Classification Search
USPC ..... 126/198, 299 R, 299 D
See application file for complete search history.

(56) References Cited

U.S. PATENT DOCUMENTS 4,788,964 A * 12/1988 Dorsey ..... F24C 15/20 126/303
5,918,589 A * 7/1999 Valle ..... F24C 15/006 126/193
6,686,576 B1 * 2/2004 Yang ..... F24C 15/2092 219/757
6,765,184 B2 * 7/2004 Yang ..... F24C 15/2092 219/400
7,034,269 B2 * 4/2006 Jeong ..... F24C 15/2092 219/757
7,482,563 B2 * 1/2009 Song ..... H05B 6/6423 219/757
2006/0219234 A1 * 10/2006 Larsen ..... F24C 15/006 126/21 R
2008/0264933 A1 * 10/2008 Jeong ..... F24C 15/2092 219/757
2009/0194090 A1 * 8/2009 Kim ..... F24C 15/006 165/104.34
2013/0149947 A1 * 6/2013 Bagwell ..... F24C 15/2007 454/49
2014/0011440 A1 * 1/2014 Savchenko ..... F24F 7/00 454/367
2015/0083106 A1 * 3/2015 Jeong ..... F24C 15/2078 126/21 A

FOREIGN PATENT DOCUMENTS

KR 20-1999-0017321 U 5/1999
KR 10-2006-0013962 2/2006
KR 10-0739156 B1 7/2007
KR 10-1026022 B1 3/2011
KR 10-2015-0016045 A 2/2015
KR 10-2016-0072483 A 6/2016

OTHER PUBLICATIONS

International Search Report dated Jan. 9, 2019 in corresponding International Application No. PCT/KR2018/010258.
Korean Office Action dated Oct. 4, 2021, in Korean Application No. 10-2017-0127899.
Office Action dated Feb. 15, 2022 in Korean Application No. 10-2017-0127899.

* cited by examiner

COOKING APPLIANCE

CROSS-REFERENCE TO RELATED APPLICATIONS

This application is a U.S. National Stage Application which claims the benefit under 35 U.S.C. § 371 of International Patent Application No. PCT/KR2018/010258 filed on Sep. 4, 2018, which claims foreign priority benefit under 35 U.S.C. § 119 of Korean Patent Application No. 10-2017-0127899 filed on Sep. 29, 2017 in the Korean Intellectual Property Office, the contents of both of which are incorporated herein by reference

TECHNICAL FIELD

The present disclosure relates to a cooking appliance disposed above a household appliance to simultaneously perform a hood function and an oven function.

BACKGROUND ART

A cooking appliance combined with a hood is a cooking appliance that is installed above a cook top, etc. and is able to simultaneously perform a hood function discharging hot air and smoke generated from the cook top to the outside.

A type commonly used in a cooking appliance combined with a hood is an oven combined with a hood or a microwave combined with a hood.

In general, a microwave oven is an appliance for cooking food by frictional heat between molecules generated by disturbing the molecular arrangement of food using high frequency as a heating source.

A cooking chamber in which food is cooked is provided in a main body of a microwave oven combined with a hood, and a blower fan for blowing smoke generated from a cook top is additionally provided in order to perform the role of the hood.

A cooking appliance includes a door installed on a front surface of a main body to selectively open and close a cooking chamber. The door may be deformed by hot air generated from a household appliance that may be installed below the cooking appliance.

In general, a base plate forming a bottom surface of the cooking appliance may perform only a function for guiding hot air generated from the household appliance to a suction port, and does not perform a function for blocking hot air transferred to the door.

DISCLOSURE

Technical Problem

The present disclosure is directed to providing a cooking appliance including a deflector capable of preventing a door from being deformed by hot air generated from a household appliance that may be installed below the cooking appliance.

The present disclosure is directed to providing a cooking appliance improved such that a deflector disperses hot air, which is generated from a household appliance that may be installed below the cooking appliance, to a bottom surface and the front of the cooking appliance.

The present disclosure is directed to providing a cooking appliance including an inclined portion through which hot air, which is generated from a household appliance that may be installed below the cooking appliance, is guided along an inclination of a deflector.

Technical Solution

One aspect of the present disclosure provides a cooking appliance including a housing, a base plate configured to be coupled to the housing, a cooking chamber disposed inside the housing, a door coupled to the housing to open and close the cooking chamber, and a deflector spaced apart from a lower end of the door and coupled to a front edge of the base plate to cover the lower end of the door from hot air generated and transferred from a household appliance installed below the base plate.

The deflector may include a coupling portion including a coupling surface in contact with the base plate, and an inclined portion bent from the coupling portion and extending downward.

The deflector may further include a step portion bent and extending from the inclined portion.

The step portion may be located in the front of the coupling portion in parallel with the coupling portion.

The inclined portion may be inclined such that one end thereof extending from the step portion is located in the front of the other end thereof extending from the coupling portion.

The coupling portion may include a locking portion configured to be locked to the base plate, and a fastening portion configured to allow the deflector to be fixed to the base plate.

The locking portion may extend from the inclined portion and may be spaced apart from the coupling surface upwardly such that the base plate is inserted therebetween.

The fastening portion may be fastened by a fastening member together with a first fastening hole of the base plate and a second fastening hole of the housing configured to allow the base plate to be fastened to the housing.

The step portion may include a body portion facing the lower end of the door, and a reinforcing portion formed by folding an edge of the body portion to reinforce the strength of the step portion.

The step portion may be located below the base plate.

A front surface of the door may be located in the front of a front edge of the step portion.

A thickness of the inclined portion may be thicker than a thickness of the front edge of the base plate.

The deflector may be made of a metal material.

The deflector may further include a cover portion bent from the step portion and extending downward to cover a gap between the lower end of the door and the deflector.

The deflector may further include a reinforcing member of a plastic material coupled to an edge of the step portion to reinforce the strength of the step portion.

Advantageous Effects

A cooking appliance according to an embodiment of the present disclosure includes a deflector such that a lower end of a door cannot be directly exposed to hot air which is generated from a household appliance that may be installed below the cooking appliance, thereby preventing deformation of the lower end of the door due to hot air.

In the cooking appliance according to an embodiment of the present disclosure, the deflector is coupled to a front edge of a base plate, thereby dispersing hot air, which is generated from a household appliance that may be installed below the cooking appliance, to the front of the door and the base plate.

In the cooking appliance according to an embodiment of the present disclosure, the deflector includes an inclined portion, so that the temperature of hot air, which is generated from a household appliance that may be installed below the cooking appliance, can be lowered as the hot air is guided along the inclined portion.

MODE OF THE INVENTION

Figure 1:
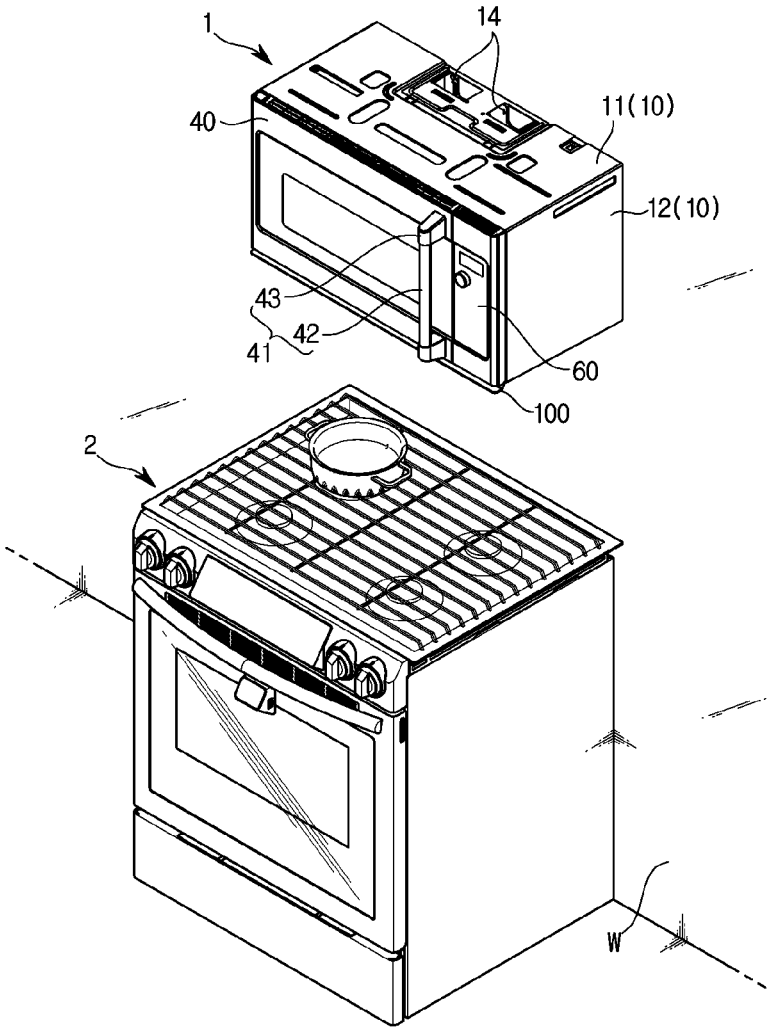
FIG. 1 is a perspective view of a cooking appliance according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component.

The term "and/or" includes any combination of a plurality of related items or any one of a plurality of related items.

The terms 'upper portion,' 'upper direction,' 'lower portion,' and 'lower direction' used herein indicate the up-down direction of a cooking appliance according to an embodiment of the present disclosure illustrated in FIG. 1. That is, in FIG. 1, the side in which the cooking appliance is located will be referred to as the upper side, and the side in which a household appliance disposed below the cooking appliance is located will be referred to as the lower side.

In the terms 'front,' 'rear,' 'front side,' and 'rear side' as used herein, the side in which a door of the cooking appliance is located in FIG. 1 will be referred to as the front side, and the opposite side thereof will be referred to as the rear side.

In addition, the left side of the front side based on the direction of the cooking appliance in FIG. 1 will be referred to as the 'left side' and the right side of the front side will be referred to as the 'right side'.

In the present disclosure, a microwave combined with a hood is illustrated as an example of a cooking appliance. However, the present disclosure is not limited to a microwave combined with a hood, and may be applied to any cooking appliance such as an oven.

Hereinafter, embodiments of the present disclosure will be described in detail with reference to the accompanying drawings.

Figure 2:
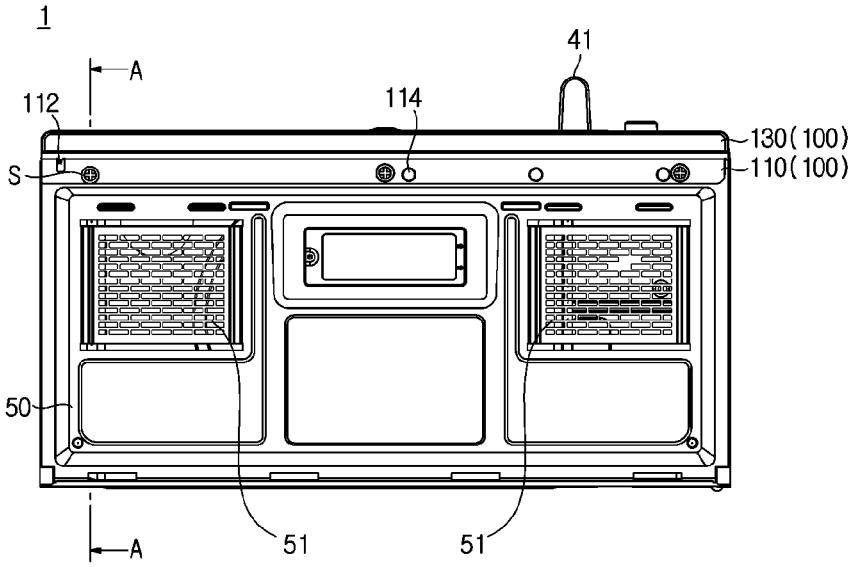
FIG. 2 is a bottom view of the cooking appliance according to an embodiment of the present disclosure.
Figure 3:
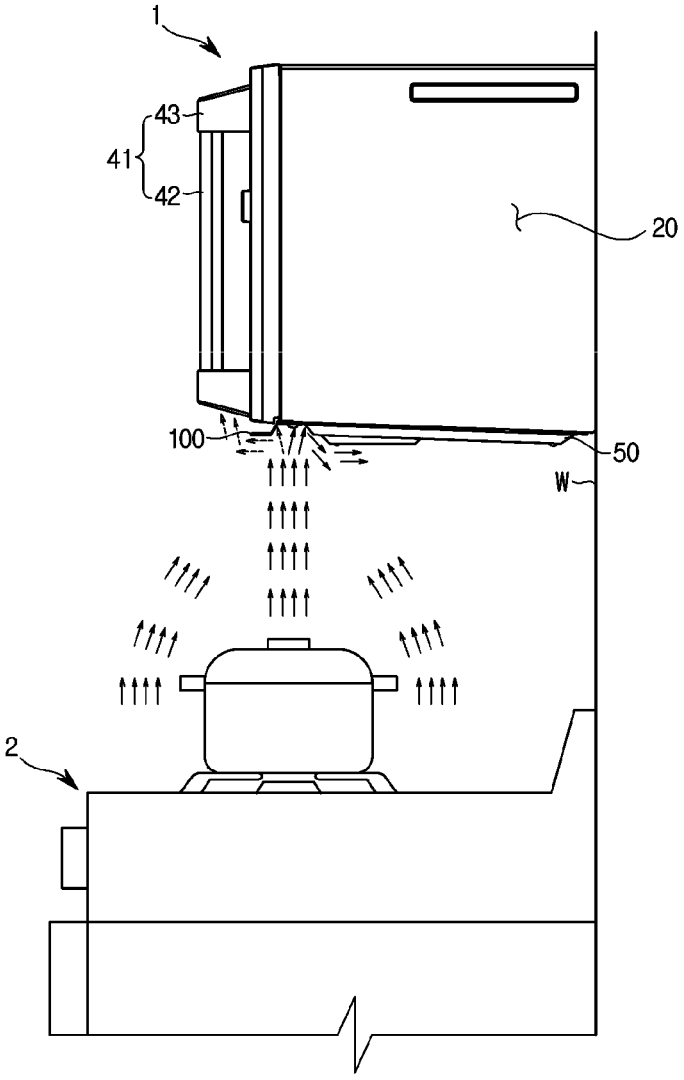
FIG. 3 is a view illustrating a state in which hot air generated from a household appliance installed below the cooking appliance according to an embodiment of the present disclosure is transferred.

FIG. 1 is a perspective view of a cooking appliance according to an embodiment of the present disclosure. FIG. 2 is a bottom view of the cooking appliance according to an embodiment of the present disclosure. FIG. 3 is a view illustrating a state in which hot air generated from a household appliance installed below the cooking appliance according to an embodiment of the present disclosure is transferred.

As illustrated in FIGS. 1 to 3, a cooking appliance 1 may be disposed above a cooktop type household appliance 2 such as a gas range and an induction range. The cooking appliance 1 may be formed in a substantially rectangular parallelepiped shape to be fixedly installed on a wall W of a building.

The cooking appliance 1 may include a housing 10 that forms an outer appearance. The housing 10 may form outer appearances of upper, sides, and rear surfaces of the cooking appliance 1. The upper, sides, and rear surfaces of the cooking appliance 1 may be integrally formed, or may be formed separately.

The housing 10 may include an upper panel 11 constituting the upper portion of the housing 10, side panels 12 constituting the side surfaces of the housing 10, and a rear panel 13 constituting the rear surface of the housing 10.

The upper panel 11, the side panels 12 and the rear panel 13 may be assembled to each other to constitute the housing 10. The front of the housing 10 is open, and the opened front may be provided with a door 40 for opening and closing the front and a controller 60 capable of operating the cooking appliance 1.

The cooking appliance 1 may include a base plate 50 forming an outer appearance of a bottom surface of the cooking appliance 1. The base plate 50 may be assembled with the housing 10.

The cooking appliance 1 may include a cooking chamber 20 forming a space for cooking food in an inner side of the housing 10. The cooking appliance 1 may include an electronic component chamber (not shown) provided to be partitioned from the cooking chamber 20 on one side of the cooking chamber 20 such that various electronic components are installed therein.

Electronic components and the like for generating microwaves to be radiated to the cooking chamber 20 may be installed in the electronic component chamber (not shown). A cooling device (not shown) for sucking outside air to cool various electronic components and the like inside the electronic component chamber (not shown) may be provided inside the electronic component chamber (not shown).

The cooking chamber 20 is opened toward the front like the housing 10, and a front surface of the opened cooking chamber 20 may be opened and closed by the door 40.

The door 40 may be hinged to the housing 10 to be rotatable with respect to the housing 10. The door 40 may be provided with a handle 41 configured such that a user may hold and pull by hand to open the door 40. The handle 41 may have a shape protruding from a front surface of the door 40.

The handle 41 may include a grip portion 42 provided to be held by the user by hand, a spacer portion 43 protruding toward the front of the door 40 from opposite sides of the grip portion 42 to allow a hand to be inserted between the grip portion 42 and the front surface of the door 40.

The handle 41 of the cooking appliance 1 may include a structure fixedly coupled to the door 40. However, the present disclosure is not limited thereto, but the handle 41 may be rotatably coupled to the door 40, and the rotation of the handle 41 may be made in conjunction with rotation of the door 40 relative to the housing 10.

The base plate 50 may include a suction port 51 configured to allow the cooking appliance 1 to suck smoke and the like generated from the household appliance 2 that may be installed below the cooking appliance 1.

A plurality of the suction ports 51 may be provided. Two of the suction ports 51 may be disposed to correspond to opposite sides of the base plate 50. However, the present disclosure is not limited thereto.

The housing 10 may include a discharge port 14 configured to discharge suction air introduced through the suction port 51 from the inside of the housing 10 to the outside.

A plurality of the discharge ports 14 may be provided. The discharge port 14 may be disposed on the upper panel 11. However, the present disclosure is not limited thereto. That is, the discharge port 14 may be disposed on the side panel 12 as well as the upper panel 11.

Hot air generated in the household appliance 2 may be sucked into the housing 10 through the suction port 51 provided on the base plate 50 and then may pass through a flow path provided inside the housing 10 to be discharged to the outside of the cooking appliance 1 through the discharge port 14 provided on the upper panel 11.

Therefore, the cooking appliance 1 may simultaneously function as a cooking appliance and function as a hood.

The controller 60 may be provided on a front surface of the cooking appliance 1. The controller 60 may be configured to operate the cooking appliance 1.

The cooking appliance 1 may include a deflector 100 coupled to the base plate 50 to prevent deformation of the door 40 or a lower end of the controller 60 by hot air generated from the household appliance 2.

The deflector 100 may be coupled to a bottom surface of the base plate 50. However, the present disclosure is not limited thereto, and the deflector 100 may be integrally formed with the base plate 50.

The deflector 100 may cover a lower end of the door 40. In a process in which hot air generated from the household appliance 2 is sucked into the suction port 51 provided on the base plate 50, a part of the hot air may direct to the front of the cooking appliance 1 which is located opposite the suction port 51.

By the hot air directing to the front, the door 40 or the lower end of the controller 60 of the cooking appliance 1 disposed adjacent to an upper side of the household appliance 2 may be deformed, and a temperature of the handle 41 of the door 40 may increase.

In general, unlike the base plate 50 made of a metal material, the door 40 or the controller 60 made of a plastic material may be more vulnerable to hot air, and the deformation of the door 40 or the controller 60 may be further accelerated by hot air. The deflector 100 may be made of a metal material. The metal material constituting the deflector 100 may be the same as the metal material constituting the base plate 50. However, the present disclosure is not limited thereto.

The deflector 100 may cover the door 40 or the lower end of the controller 60 such that hot air generated from the household appliance 2 does not directly come into contact with the door 40 or the lower end of the controller 60.

Hereinafter, a process in which hot air generated from the household appliance 2 flows into the cooking appliance 1 that may be installed above the household appliance 2 will be described with reference to FIG. 3.

The hot air generated from the household appliance 2 which may be installed below the cooking appliance 1 and directing to the cooking appliance 1 may be mostly sucked into the suction port 51 provided on the base plate 50.

However, a part of the hot air that is not sucked by the suction port 51 may move toward the front of the cooking appliance 1 to deform the door 40 or the lower end of the controller 60 disposed adjacent to the upper side of the household appliance 2.

The deflector 100 coupled to the base plate 50 may cover the door 40 or the lower end of the controller 60 from a part of hot air moving toward the front of the cooking appliance 1.

A part of hot air generated from the household appliance 2 and directing to the front of the cooking appliance 1 may be sucked back into the suction port 51 by coming into contact with the deflector 100, and the hot air moved to the front of the cooking appliance 1 along the deflector 100 may come into contact with the door 40 or the lower end of the controller 60 in a state in which the temperature thereof becomes relatively lowered.

Therefore, the deflector 100 may prevent deformation of the door 40 or the controller 60 by a part of hot air generated from the household appliance 2 and moving to the front of the cooking appliance 1.

Figure 4:
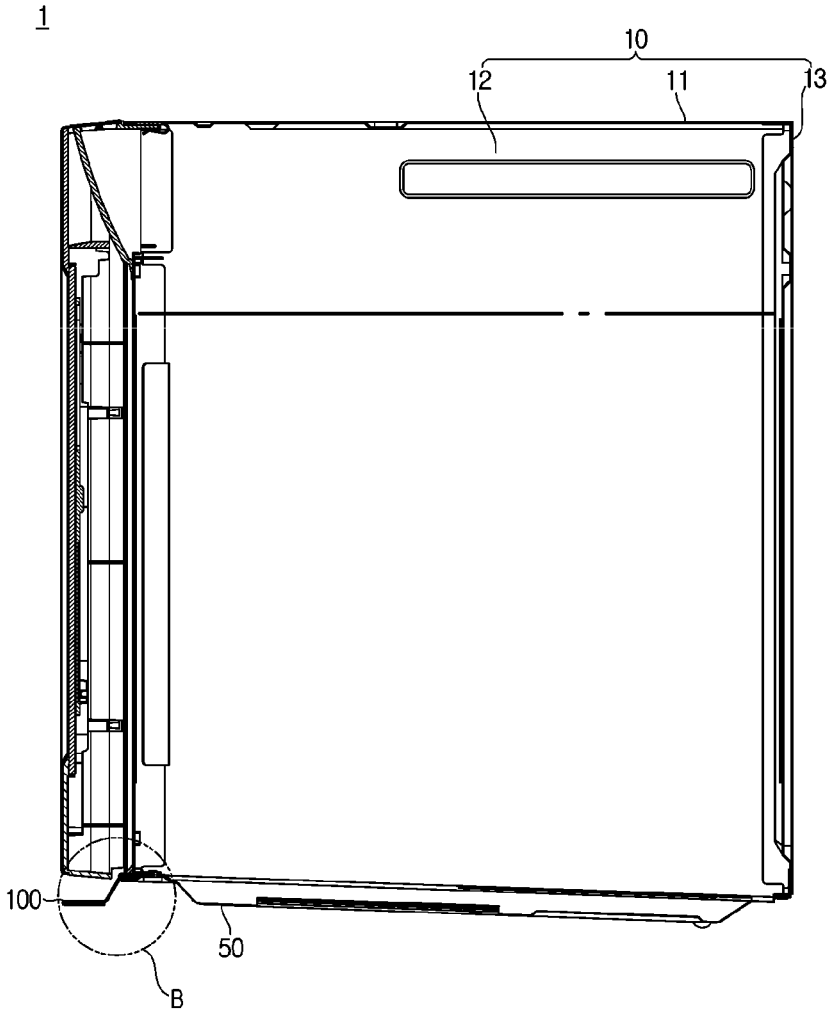
FIG. 4 is a sectional view taken along line A-A in FIG. 2 in the cooking appliance according to an embodiment of the present disclosure.
Figure 5:
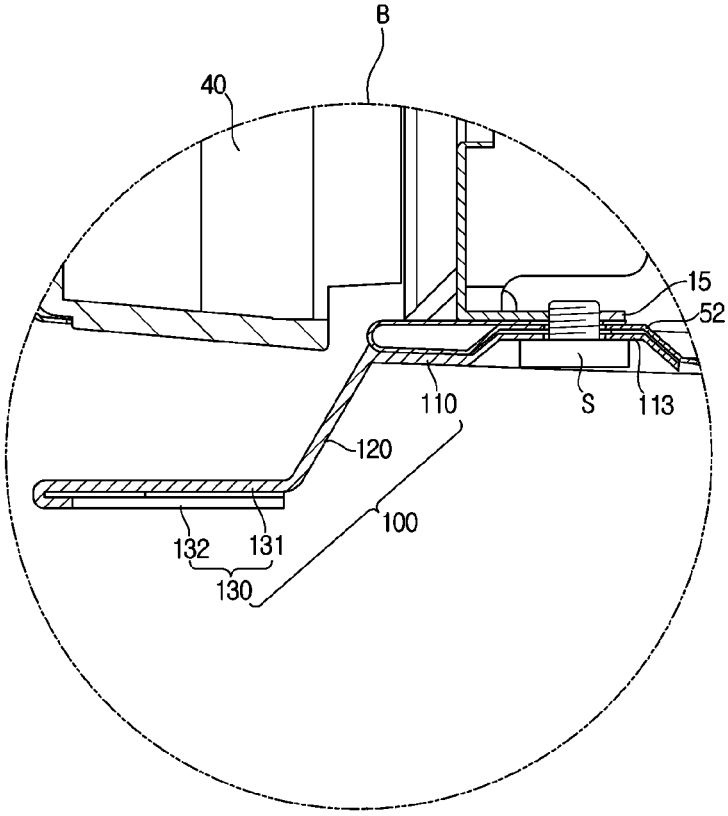
FIG. 5 is an enlarged view of a portion B in FIG. 4 in the cooking appliance according to an embodiment of the present disclosure.

FIG. 4 is a sectional view taken along line A-A in FIG. 2 in the cooking appliance according to an embodiment of the present disclosure. FIG. 5 is an enlarged view of a portion B in FIG. 4 in the cooking appliance according to an embodiment of the present disclosure.

As illustrated in FIGS. 4 and 5, the cooking appliance 1 may include the deflector 100 coupled to a front edge of the base plate 50. The deflector 100 may be spaced apart from the lower end of the door 40 in parallel with the front edge of the base plate 50.

The deflector 100 may disperse hot air generated from the household appliance 2 to the front of the door 40 and the base plate 50 by being disposed at the front edge of the base plate 50.

The deflector 100 may include a coupling portion 110 in contact with the front edge of the base plate 50, and an inclined portion 120 bent from the coupling portion 110 and extending downward.

Because the deflector 100 includes the inclined portion 120, the temperature of hot air generated from the household appliance 2 may be lowered while hot air is guided along the inclined portion 120.

The deflector 100 may include a step portion 130 bent and extending from the inclined portion 120 to cover the lower end of the door 40.

The step portion 130 may be located in the front of the coupling portion 110 in parallel with the coupling portion 110. The step portion 130 may be disposed to be spaced apart from the door 40 or the lower end of the controller 60 to cover the door 40 or the lower end of the controller 60.

The inclined portion 120 may be inclined such that one end thereof extending from the step portion 130 is located in the front of the other end thereof extending from the coupling portion 110. That is, the inclined portion 120 may be inclined such that a lower end of the inclined portion 120 faces the front and an upper end of the inclined portion 120 faces the rear.

The step portion 130 may include a body portion 131 facing the lower end of the door 40 and a reinforcing portion 132 formed by folding an edge of the body portion 131 to reinforce the strength of the step portion 130.

The reinforcing portion 132 may be formed by folding the edge of the body portion 131 downward. However, the present disclosure is not limited thereto. The reinforcing portion 132 may allow the edge of the body portion 131 to be relatively thick compared to other portions of the deflector 100 such as the inclined portion 120.

Therefore, the strength of the step portion 130 may be reinforced, so that the step portion 130 may be prevented from being deformed when an operator misses the cooking appliance 1 and the step portion 130 collides with a floor surface in the process of carrying or installing the cooking appliance 1.

The reinforcing portion 132 may be configured to round the edge of the body portion 131, so that the operator may be prevented from being injured by the edge of the body portion 131 when carrying or installing the cooking appliance 1.

The reinforcing portion 132 may be configured to round the edge of the body portion 131, so that a sense of beauty of an outer appearance of the deflector 100 may be improved.

The step portion 130 may be located below the base plate 50. The step portion 130 may be spaced apart from the lower end of the door 40. A distance between the step portion 130 and the front lower end portion of the door 40 may be suitably 20 mm or less. However, the present disclosure is not limited thereto.

The front surface of the door 40 may be located in the front of a front edge of the step portion 130. A distance between the front surface of the door 40 and the front edge of the step portion 130 may be suitably 0.5 mm to 1.5 mm. However, the present disclosure is not limited thereto.

The inclined portion 120 may extend to be inclined from the coupling portion 110. An angle of the inclined portion 120 inclined from the coupling portion 110 may suitably be 110 degrees to 130 degrees. However, the present disclosure is not limited thereto.

The deflector 100 may be fastened to the base plate 50 by a fastening member S. The base plate 50 may be fastened to the housing 10 by the fastening member S. That is, the deflector 100, the base plate 50 and the housing 10 may be integrally fastened by the same fastening member S.

The base plate 50 may include a first fastening hole 52 to which the fastening member S is fastened. The housing 10 may include a second fastening hole 15 to which the fastening member S is fastened. The coupling portion 110 may include a fastening portion 113 to which the fastening member S is fastened.

The fastening member S may be fastened to the fastening portion 113, the first fastening hole 52 and the second fastening hole 15 in order. That is, in the cooking appliance 1 fastened by the fastening member S, the first fastening hole 52 may be disposed above the fastening portion 113, and the second fastening hole 15 may be disposed above the first fastening hole 52.

Figure 6:
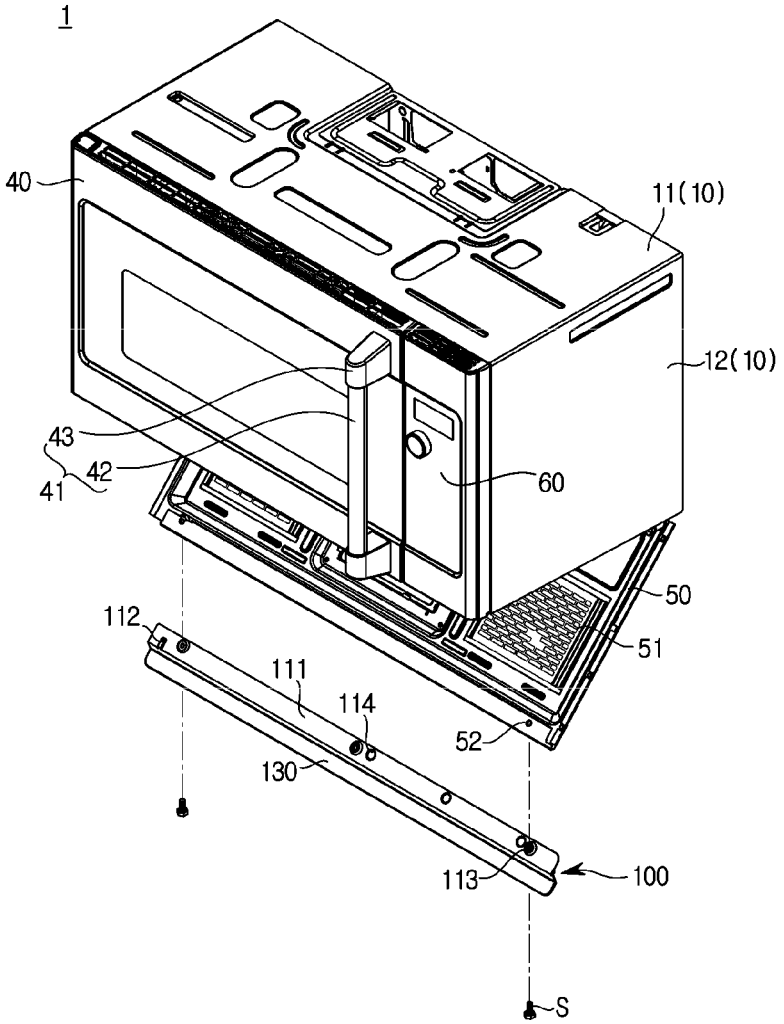
FIG. 6 is an exploded view of a housing, a base plate and a deflector in the cooking appliance according to an embodiment of the present disclosure.
Figure 7:
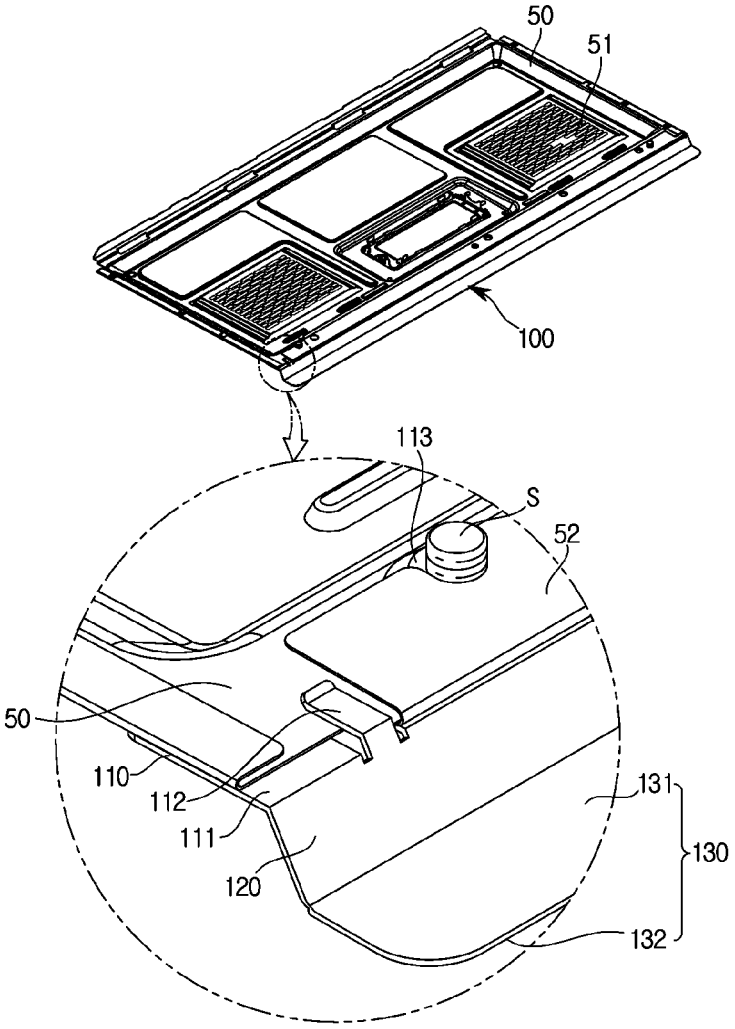
FIG. 7 is a view illustrating the deflector coupled to the base plate in the cooking appliance according to an embodiment of the present disclosure.
Figure 8:
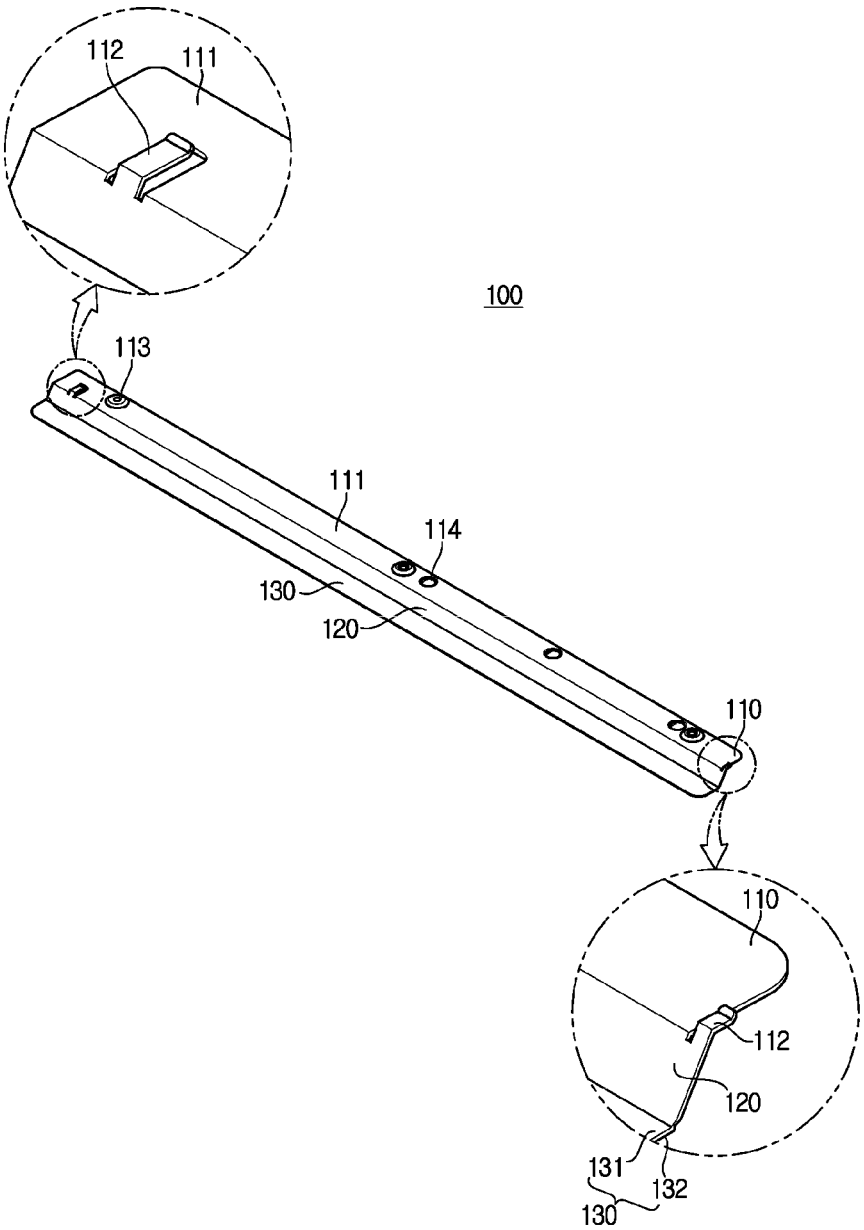
FIG. 8 is a view illustrating the deflector in the cooking appliance according to an embodiment of the present disclosure.

The fastening portion 113 may protrude upward from a coupling surface 111 and may include a hole to allow the fastening member S to penetrate therethrough. FIG. 6 is an exploded view of a housing, a base plate and a deflector in the cooking appliance according to an embodiment of the present disclosure. FIG. 7 is a view illustrating the deflector coupled to the base plate in the cooking appliance according to an embodiment of the present disclosure. FIG. 8 is a view illustrating the deflector in the cooking appliance according to an embodiment of the present disclosure.

As illustrated in FIGS. 6 to 8, the base plate 50 may be hinged to the housing 10. The base plate 50 may be hinged to the rear panel 13.

The deflector 100 may be coupled to the front edge of the base plate 50. The front edge of the base plate 50 may be coupled to the coupling portion 110. The deflector 100 may have a length corresponding to the base plate 50 in a horizontal direction of the cooking appliance 1.

The coupling portion 110 may include the coupling surface 111 in contact with the front edge of the base plate 50, a locking portion 112 provided on the coupling surface 111 to be locked to the base plate 50, and the fastening portion 113 provided on the coupling surface 111 such that the deflector 100 is fixed to the base plate 50.

A plurality of the locking portions 112 may be provided. A plurality of the fastening portions 113 may be provided. The number of the fastening members S, and the number of the first fastening holes 52 and the second fastening holes 15 integrally fastened to the fastening portions 113 by the fastening members S may correspond to the number of the fastening portions 113.

The locking portion 112 extends from the inclined portion 120 and may be spaced upwardly from the coupling surface 111 such that the base plate 50 is inserted. The front edge of the base plate 50 may be inserted between the coupling surface 111 and the locking portion 112.

The front edge of the base plate 50 may be disposed above the coupling surface 111 and may be disposed below the locking portion 112.

Hereinafter, a process in which the deflector 100 is installed in the cooking appliance 1 will be described with reference to FIGS. 6 and 7.

First, the front edge of the base plate 50 may be separated from the rear panel 13 by hinge rotation of the base plate 50, and the deflector 100 may be coupled to the separated front edge of the base plate 50.

As the front edge of the base plate 50 is inserted between the coupling surface 111 and the locking portion 112, the base plate 50 and the coupling portion 110 may be locked and coupled to each other.

As the base plate 50 to which the deflector 100 is locked and coupled is rotated with respect to the rear panel 13, the base plate 50 to which the deflector 100 is coupled may be assembled to the housing 10.

Next, as the second fastening hole 15 of the housing 10, the first fastening hole 52 of the base plate 50, and the fastening portion 113 of the coupling portion 110 are integrally fastened through the fastening member S, the coupling portion 110 may be fixedly coupled to the base plate 50. The deflector 100 may be coupled to the cooking appliance 1 by the above procedure.

A thickness of the deflector 100 may be thicker than a thickness of the front edge of the base plate 50. A thickness of the inclined portion 120 may be thicker than the thickness of the front edge of the base plate 50.

Therefore, the strength of the deflector 100 may be reinforced, so that the deflector 100 may be prevented from being deformed when the operator misses the cooking appliance 1 and the cooking appliance 1 and the deflector 100 collide with the floor surface in the process of carrying or installing the cooking appliance 1. The thickness of the deflector 100 may be suitably 1 mm or more.

The deflector 100 may include a receiving portion 114 disposed on the coupling portion 110. A plurality of the receiving portions 114 may be provided on the coupling surface 111. The receiving portion 114 may be formed in a groove shape recessed downward from the coupling surface 111.

A clamp (not shown) for fixing an electric wire (not shown) or the like for operating the cooking appliance 1 through the controller 60 may be received in the receiving portion 114.

FIG. 8 illustrates that two of the locking portions 112 are provided on opposite sides of the coupling portion 110, respectively, but the present disclosure is not limited thereto.

The locking portion 112 disposed on one side of the coupling portion 110 may be positioned above the coupling surface 110, and the locking portion 112 disposed on the other side of the coupling portion 110 may be positioned on a side portion of the coupling surface 110.

One end of the locking portion 112 extends from one end of the inclined portion 120 along an inclination of the inclined portion 120 and may be bent in a direction parallel to the coupling surface 111. The other end of the locking portion 112 may be bent to have the same inclination as the inclined portion 120.

Figure 9:
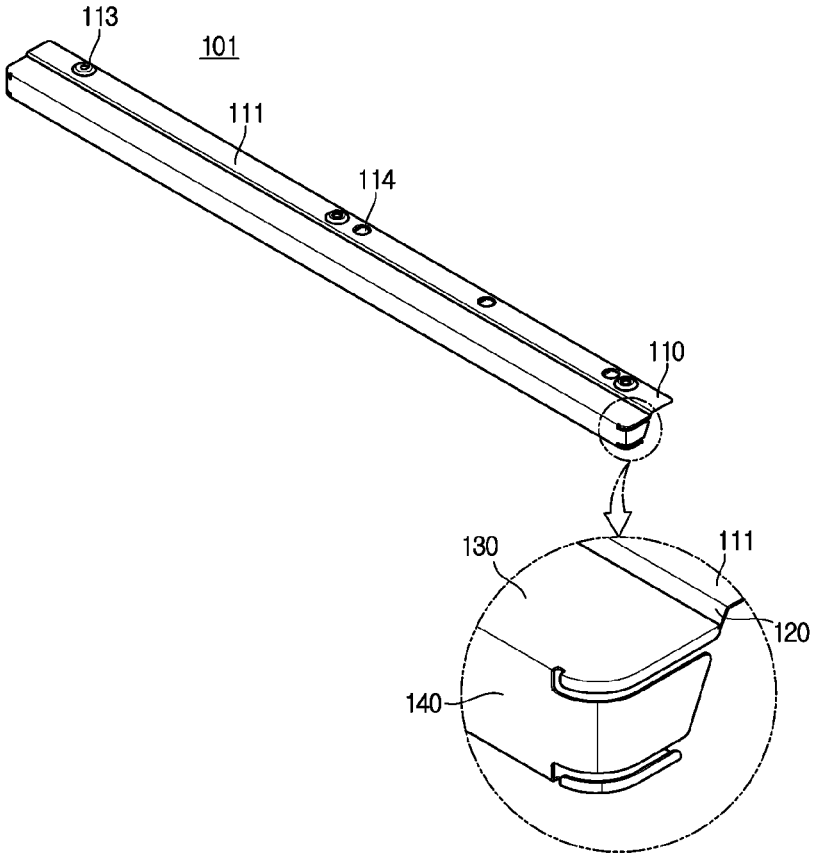
FIG. 9 is a view illustrating a deflector in a cooking appliance according to another embodiment of the present disclosure.

FIG. 9 is a view illustrating a deflector in a cooking appliance according to another embodiment of the present disclosure. A deflector 101 according to another embodiment is mostly similar to the deflector 100 according to an embodiment, but there is different in that the deflector 101 includes a cover portion 140.

Description of the same components as those of the deflector 100 according to an embodiment may be omitted.

As illustrated in FIG. 9, the deflector 101 may include a cover portion 140 bent from the step portion 130 and extending downward. Therefore, a sense of beauty of an outer appearance of the deflector 101 may be improved.

A length of the inclined portion 120 of the deflector 101 may be relatively short compared to a length of the inclined portion 120 of the deflector 100 according to an embodiment. A length from one end of the inclined portion to the front edge of the step portion 130 may be suitably 26 mm. However, the present disclosure is not limited thereto.

The cover portion 140 may cover an edge of the step portion 130. A length from the coupling surface 111 to a lower edge of the cover portion 140 may be suitably 32 mm. However, the present disclosure is not limited thereto.

Figure 10:
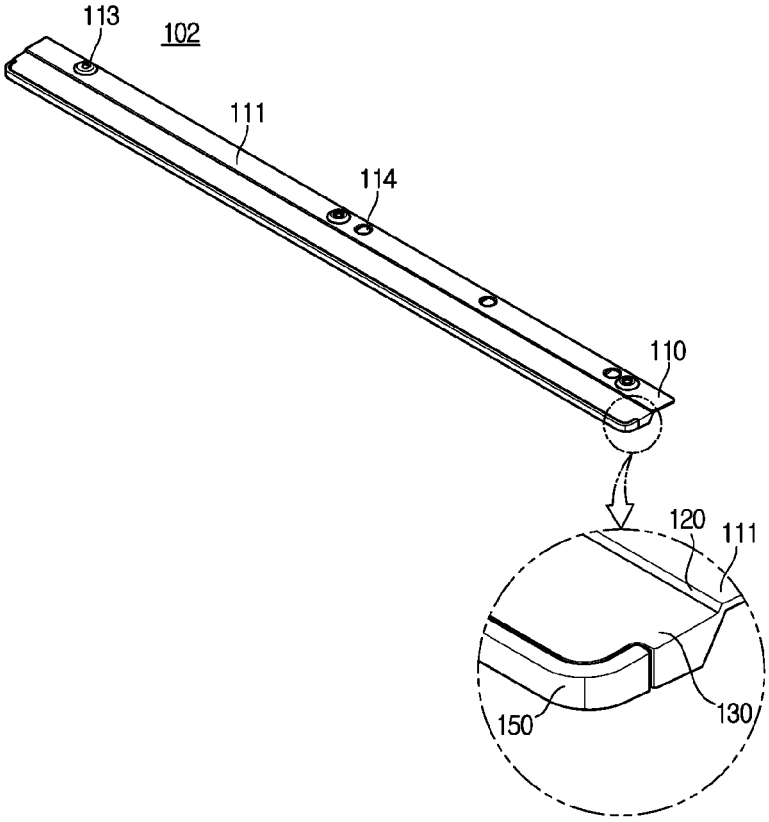
FIG. 10 is a view illustrating a deflector in a cooking appliance according to another embodiment of the present disclosure.

FIG. 10 is a view illustrating a deflector in a cooking appliance according to another embodiment of the present disclosure. A deflector 102 according to another embodiment is mostly similar to the deflector 100 according to an embodiment, but there is different in that the deflector 101 includes a reinforcing member 150.

Description of the same components as those of the deflector 100 according to an embodiment may be omitted.

As illustrated in FIG. 10, the deflector 102 may include the reinforcing member 150 coupled to the edge of the step portion 130 to reinforce the strength of the step portion 130.

Unlike the step portion 130, the reinforcing member 150 may be made of a plastic material. The reinforcing member 150 may cover a gap between the lower end of the door 40 and the deflector 102. Therefore, a sense of beauty of an outer appearance of the deflector 102 may be improved.

A length of the inclined portion 120 of the deflector 102 may be relatively short compared to the length of the inclined portion 120 of the deflector 100 according to an embodiment. The reinforcing member 150 may cover the edge of the step portion 130.

While the present disclosure has been particularly described with reference to exemplary embodiments, it should be understood by those of skilled in the art that various changes in form and details may be made without departing from the spirit and scope of the present disclosure.

The invention claimed is:

1. A cooking appliance comprising:
- a housing;
- a base plate configured to be coupled to the housing;
- a cooking chamber disposed inside the housing;
- a door coupled to the housing to open and close the cooking chamber; and
- a deflector spaced apart from a lower end of the door and coupled to a front edge of the base plate to cover the lower end of the door from hot air generated and transferred from a household appliance installed below the base plate, wherein the deflector comprises:
- a coupling portion including a coupling surface in contact with the base plate;
- an inclined portion bent from the coupling portion and extending downward; and
- a step portion bent and extending from the inclined portion and located below the base plate.

2. The cooking appliance according to claim 1, wherein the step portion is located in front of the coupling portion in parallel with the coupling portion.

3. The cooking appliance according to claim 1, wherein the inclined portion is inclined such that one end thereof extending from the step portion is located in front of the other end thereof extending from the coupling portion.

4. The cooking appliance according to claim 1, wherein the coupling portion comprises a locking portion configured to be locked to the base plate, and a fastening portion configured to allow the deflector to be fixed to the base plate.

5. The cooking appliance according to claim 4, wherein the locking portion extends from the inclined portion and is spaced apart from the coupling surface upwardly such that the base plate is inserted between the coupling surface and the locking portion.

6. The cooking appliance according to claim 4, wherein the fastening portion is fastened by a fastener passing through a first fastening hole of the base plate and a second fastening hole of the housing configured to allow the base plate to be fastened to the housing.

7. The cooking appliance according to claim 1, wherein the step portion comprises a body portion facing the lower end of the door, and a reinforcing portion formed by folding an edge of the body portion to reinforce the strength of the step portion.

8. The cooking appliance according to claim 1, wherein a front surface of the door is located in front of a front edge of the step portion.

9. The cooking appliance according to claim 1, wherein a thickness of the inclined portion is thicker than a thickness of the front edge of the base plate.

10. The cooking appliance according to claim 1, wherein the deflector is made of a metal material.

11. The cooking appliance according to claim 1, wherein the deflector further comprises a cover portion bent from the step portion and extending downward.

12. The cooking appliance according to claim 1, wherein the deflector further comprises a reinforcing member made of a plastic material coupled to an edge of the step portion to reinforce the strength of the step portion.

* * * * *